US006648533B2

(12) United States Patent
Lo et al.

(10) Patent No.: US 6,648,533 B2
(45) Date of Patent: Nov. 18, 2003

(54) LABEL-MAKING INKJET PRINTER

(75) Inventors: Clement C. Lo, Lake Oswego, OR (US); Thomas A. Saksa, Albany, OR (US); Andrew S. P. Chiu, Kowloon (HK)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/032,976

(22) Filed: Oct. 19, 2001

(65) Prior Publication Data

US 2003/0001940 A1 Jan. 2, 2003

Related U.S. Application Data

(63) Continuation-in-part of application No. 09/895,346, filed on Jun. 29, 2001.

(51) Int. Cl.[7] ..... B41J 11/26

(52) U.S. Cl. ..... 400/621; 400/208; 400/605; 400/613; 347/101; 156/234

(58) Field of Search ..... 400/621, 208, 400/605, 611, 613; 347/101, 104, 105, 222; 156/234

(56) References Cited

U.S. PATENT DOCUMENTS

| | | | | |
|---|---|---|---|---|
| 4,379,804 A | | 4/1983 | Eisele et al. | |
| 4,446,174 A | * | 5/1984 | Maekawa et al. | 347/105 |
| 4,649,064 A | | 3/1987 | Jones | |
| 4,903,041 A | | 2/1990 | Light | |
| 4,904,519 A | | 2/1990 | Newman | |
| 4,927,278 A | | 5/1990 | Kuzuya et al. | |
| 4,935,307 A | | 6/1990 | Iqbal et al. | |
| 5,002,825 A | | 3/1991 | Mimura et al. | |
| 5,023,129 A | | 6/1991 | Morganti et al. | |
| 5,084,338 A | | 1/1992 | Light | |
| 5,141,797 A | | 8/1992 | Wheeler | |
| 5,208,092 A | | 5/1993 | Iqbal | |
| 5,212,008 A | | 5/1993 | Malhotra et al. | |
| 5,302,437 A | | 4/1994 | Idei et al. | |
| 5,614,928 A | | 3/1997 | Matsuda | |
| 5,723,202 A | * | 3/1998 | Mueller | 428/194 |
| 5,827,389 A | * | 10/1998 | Takizawa et al. | 156/234 |
| 5,943,085 A | * | 8/1999 | Higashi et al. | 347/222 |
| 6,030,133 A | * | 2/2000 | Endo | 400/88 |
| 6,068,374 A | * | 5/2000 | Kurata et al. | 347/101 |
| 6,099,179 A | * | 8/2000 | Higashi et al. | 400/613 |
| 6,132,119 A | * | 10/2000 | Nakajima et al. | 400/613 |
| 6,186,684 B1 | | 2/2001 | Bane et al. | |
| 6,215,508 B1 | | 4/2001 | Bryan et al. | |
| 6,280,106 B1 | * | 8/2001 | Juan et al. | 400/605 |
| 6,287,031 B1 | * | 9/2001 | Willis | 400/621 |
| 6,332,725 B1 | * | 12/2001 | Palmer et al. | 400/208 |

FOREIGN PATENT DOCUMENTS

| | | |
|---|---|---|
| WO | WO 97/46389 | 12/1997 |
| WO | WO 00/28379 | 5/2000 |

OTHER PUBLICATIONS

Dymo, Stamp Manager Marketing Brochure, May 7, 2000.

* cited by examiner

*Primary Examiner*—Eugene H. Eickholt

(57) ABSTRACT

A label making inkjet printer applies print imaging directly to the adhesive side of a media provided in sheet-form and in reel-form. Because inkjet printing is a non-contact printing method, print imaging may be applied to the adhesive side of the media. According to one embodiment, a user manually pulls tape-form media through the printer while encoding signals detect linear movement of the media and provide basis for synchronizing operation of an inkjet print head. According to another embodiment, a motorized media transport carries tape-form media on a pair of media transport belts past an inkjet print head. The resulting adhesive label when applied to a contact surface substantially disappears due to its transparent nature leaving visible only print imaging applied thereto and captured between the protective tape media and contact surface therebelow.

13 Claims, 7 Drawing Sheets

LABEL-MAKING INKJET PRINTER

RELATED APPLICATIONS

The present invention is a continuation-in-part of prior-filed co-pending U.S. Patent Application filed Jun. 29, 2001 under Ser. No. 09/895,346 and entitled Techniques For Printing Onto A Transparent Receptor Media Using An Inkjet Printer.

BACKGROUND OF THE INVENTION

The present invention relates generally to printing devices, and particularly to label-making printers.

A label includes print imaging and an adhesive surface. The print imaging typically represents some text or graphic content identifying, characterizing, quantifying, or otherwise referencing some article. Labels on consumer items contain bar codes for inventory control, price information, or, generally, to identify characteristics of the goods or the source of such goods. Labels on food items, for example, contain images, such as text or graphics, that describe or portray the product. Currently, labels find limited application in other more creative and personal applications. For example, labels may be decorative as applied to gifts or packaging. Conventional label making methods and label-media fall short, however, of the potential for labels as a convenient, i.e., easily produced and used, device presenting selected print imaging for display on a contact surface.

The bulk of conventional home, small office, and personal printing involves application of text and images on sheet-form media. Most typically, the sheet-form media is paper, e.g., 8½ by 11 inch sheets. Other media sizes include envelope sizes, card stock sizes, and other conventional paper sizes, e.g., A-4 paper size. Accordingly, conventional printers include paper transport and print head arrangements particularly adapted for such media sizes. Most printers allow media size variation by multiple source trays, by modification in paper tray compartments and by front-fed arrangements. A user thereby applies print imaging to such variety of paper sizes from small card stock to large sheet-form media.

Unfortunately, most printers have a lower limit on the size of media carried by the paper transport mechanism and print head operation in relation thereto. For many applications, e.g., from printing postcards to envelopes to sheet-form media, this lower boundary in media size represents no problem.

Print imaging on a label typically appears on the uppermost surface of the label. Since the image is exposed, it is vulnerable to moisture and scuffing, which degrade the quality of the image. In some commercial applications, the image is protected by applying a clear film over the image. When a printed label is applied to the item, a border is created because the label is thick and does not blend into the background of the item. This commonly happens, for example, when a white label is applied to a colored background. While aesthetic concerns are not an issue in all applications, aesthetics are important when the user wants the labeled item to look professional or when labels are used in more creative and artistic applications. In some applications, images are printed onto transparent labels so that the label blends into the background of the item. However, the print is located on the upper surface of the label and is, therefore, still exposed to moisture and scuffing. For home uses, the image may be laminated to protect it from moisture and scuffing. However, this approach is disadvantageous since lamination increases the overall thickness of the image, adds additional steps to the process, and requires a laminating device.

Label-making printing operations present challenge, therefore, with respect to conventional printer operation. Individual labels, in many cases, are smaller than the typical lower size limit manageable by most printers. In other words, printers are typically not adapted to handle especially small media sizes and, therefore, are not well suited for printing on individual labels. Several approaches to label-making have evolved to overcome this challenge.

First, because conventional printers are most suitably adapted for sheet-form media, e.g., 8½ by 11 inch sheets, labels often come as an array of labels grouped together on an 8½ by 11 inch sheet. Typically, such label sheets include a waxy back sheet to which the labels adhere. As such, most printers accept and transport past a printing zone a sheet of labels and apply appropriate text and graphics thereto. Unfortunately, the user must pass through the printer an entire sheet of labels even when only a single label is required. In other words, the user sends through the printer the entire label sheet for the sake of printing a single label. While in some applications it is possible to make use of all labels on the sheet, this presents certain inconvenience and inefficiency when a user wishes to produce fewer than an entire sheet of labels. Once a user sends a label sheet through a printer and removes one or more labels, it is generally unadvisable to send the label sheet back through the printer with one or more labels removed from the back sheet. Although some special label sheets have been proposed allowing multiple passes through a printer, such use presents risk of contamination within the printer paper transport and printing system when exposed to the waxy back sheet.

Second, printers have evolved as dedicated label-making printers. These label-making printers are small printers having the capability of printing individual labels. Unfortunately, such dedicated label-making printers, while capable of printing single labels at a time, are limited in the size of labels produced. In other words, the labels are of fixed or bordered size and printing applications must adapt to this limited size when producing labels. Furthermore, such printers are generally incapable of producing graphics or color image presentation. Accordingly, dedicated label-making printers do provide advantage in their ability to produce single labels but suffer from limited output capabilities in terms of size and image presentation.

In any case, label making presents certain challenge or additional effort, especially when the labels are relatively small. It would be desirable, therefore, to more conveniently produce labels, i.e., media bearing print imaging and an adhesive surface.

Other known label making methods involve using inkjet receptor compositions suitable for coating onto plastics to make the plastics inkjet receptive. For example, applications for overhead transparencies are known in the art. These are composed of transparent plastic materials such as polyester, which alone will not accept the aqueous inks and are therefore coated with receptor layers. Typically these receptor layers are composed of mixtures of water soluble polymers which can absorb the aqueous mixture from which the inkjet ink comprises, such as hydrophilic layers having poly (vinyl pyrrolidone) or poly (vinyl alcohol), as described in U.S. Pat. Nos. 4,379,804; 4,903,041; and 4,904,519. Also known are methods of cross-linking hydrophilic polymers in the receptor layers as disclosed in U.S. Pat. Nos. 4,649,064; 5,141,797; 5,023,129; 5,208,092; and 5,212,008. Other coating compositions contain water-absorbing particulates such as inorganic oxides, as disclosed in U.S. Pat. Nos. 5,084,338; 5,023,129; and 5,002,825, or those containing particulates, such as cornstarch, as disclosed in U.S. Pat. Nos. 4,935,307 and 5,302,437.

Many of these types of inkjet receptor media, however, are less than ideal for image graphics because they include water-sensitive polymer layers. Even if subsequently overlaminated, they still contain a water-soluble or water-swellable layer, which, in time, can be subject to extraction with water and can lead to damage of the graphic and liftoff of the overlaminate. Additionally, some of the common constituents of these hydrophilic coatings contain water-soluble polymers not ideally suitable to the heat and UV exposures experienced in exterior environments, thus limiting their exterior durability. Finally, the drying rate after printing of these materials appears slow since until dry, the coating is plasticized or even partially dissolved by the ink solvents (mainly water) so that the image can be easily damaged and can be tacky before it is dry.

In the commercial setting, labels are printed by a number of processes known in the art, such as screen printing, thermal transfer printing, and inkjet printing. These processes vary dramatically in cost and the resolution of the printed images that are produced. Screen printing and thermal transfer printing are typically limited to commercial applications because they produce large numbers of identical labels and require use of expensive equipment. Screen printing is commonly used to print the transparent labels, such as those used on electronics and appliances. While the images may be screen-printed onto the reverse side of a transparent label, the adhesive is applied after the image is printed, which adds an additional step to the process, making it impractical or cost prohibitive for low-volume, non-commercial, or personal use.

Thermal transfer printing is a contact printing process where a thermally reactive ribbon is located between a thermal print head and a print media onto which the image is to be printed. The print head contains heating elements that are selectively energized. As the ribbon is heated, ink is transferred from the ribbon to the print media to create the printed image. Images created by thermal transfer printing are located on the upper surface of the media and are, therefore, vulnerable to moisture and scuffing. The higher cost of thermal transfer printers makes it economically impractical for use as personal printers.

An exemplary type of thermal transfer printer is a label printer. Label printers are commonly used in grocery stores to label food items with transparent labels. An exemplary Label printer is disclosed in U.S. Pat. No. 4,927,278 issued to Kuzuya et al. Label printers currently available on the market include products by Kroy LLC and Zebra Technologies.

Inkjet printers have come into general use for wide-format electronic printing for a broad and varied range of applications. Because of the simplicity of operation and economy of inkjet printers, this printing process holds a superior growth potential promise for the printing industry to produce wide format, image on demand, presentation quality graphics. The components of an inkjet system used for making graphics can be grouped into three major categories: 1) computer, software, printer; 2) ink; and 3) receptor medium. The computer, software, and printer will control the size, number and placement of the ink drops and will transport the receptor medium through the printer. The ink will contain the colorant which forms the image and carrier for that colorant. The receptor medium provides the repository which accepts and holds the ink. The quality of the inkjet image is a function of the total system. However, the composition and interaction between the ink and receptor medium is most important in an inkjet system.

Inkjet printers are commonly purchased as personal printers because they are easy to use, produce high quality, color images, and are less expensive than thermal transfer printers. Inkjet printers are also available in a variety of formats that allow the user to print professional-looking banners or conventional labels at home. Ink-jet printing is a non-contact printing process in which droplets of ink are deposited on a print media. In response to electrical signals generated by a microprocessor, fine droplets of ink are ejected onto print media such as paper, transparency film, or textiles. The ejection of ink droplets in a particular order forms alphanumeric characters, area fills, and other patterns on the print media. Images are printed onto many types of media including paper or transparent, plastic receptor media such as transparent labels or overhead transparencies. However, inkjet inks compositions are substantially aqueous-based and do not adhere to the inherently hydrophobic surface of plastic receptor media. Therefore, to print images onto plastic receptor media, these media must first be coated with a hydrophilic film to improve its affinity for the inkjet ink. The image is printed on top of the hydrophilic film, however, and not protected from moisture and scuffing.

Thus, labels are typically be applied to a contact surface for display purposes and such positioning presents risk of smudging or damage to the text or graphics thereon. In other words, frequently labels are applied in areas exposed to abrasive contact or other such environmental degradation. Certain printing methods, e.g., inkjet printing methods, can be susceptible to smudging or degradation due to abrasion.

It would be desirable, therefore, to provide a convenient label-making media and label-making printer having greater flexibility in the size of labels produced as well as a capability of producing both images and text across a variety of fonts and colors with protection against degradation in use thereof. The subject matter of the present invention provides such a label-making printer.

SUMMARY OF THE INVENTION

The present invention proposes application of print imaging to the adhesive portion of a label. As a result, such print imaging is captured between the body of the label and a contact surface to which the label adheres. Media under the present invention may be provided in cartridge form including an encoding device reporting movement of the media. In one aspect of the present invention, media may take the form of adhesive tape and be deployed from a printer under the present invention taking generally the form of a tape dispenser. In one aspect of the present invention, such printer may react to manual deployment of tape by application of print imaging. In another aspect of the invention, a motorized printer applies print imaging to an adhesive surface of a label carried therepast and presented for collection by a user. Use of a detector to report movement of tape media under the present invention provides basis for metering of print imaging onto an adhesive.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

The present invention proposes application of print imaging on an adhesive surface of a plastic receptor media. Generally, the image is printed onto the adhesive surface using inkjet printer technology. After the image is printed, the receptor media is applied to an item, thereby "labeling" the item with the print imaging. Since the image is printed onto the adhesive surface, it is protected from moisture and scuffing after it is applied to the item.

The present invention will be illustrated in several variations of media, printing apparatus, and methods of use. Generally, the present invention allows label-making on strip-form media. In one embodiment, media mounts to a backing sheet and passes through a conventional inkjet printer. In other embodiments, however, the strip-form media feeds from a reel. The present invention may be embodied in printing devices generally taking the form of a tape dispenser, but applying print imaging to the adhesive side of the tape. As a result, a variety of label-making printing operations are possible. In other words, the present invention proposes, in certain aspects, production of labels as easily as pulling tape from a tape dispenser and applying the resulting label to a display surface.

Figure 1:
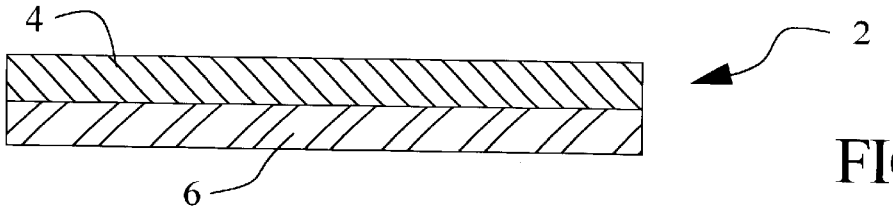
FIG. 1 shows a transparent tape according to one aspect of the present invention.

As illustrated in FIG. 1, a receptor media 2 is transparent and has a plastic layer 4 at the top surface and an adhesive layer 6 at the bottom surface. The plastic layer 4 is composed of any thin, flexible plastic known in the art, such as polyester, vinyl, Mylar® (polyethylene terephthalate), or cellophane. The adhesive layer 6 is composed of any suitable adhesive known in the art, such as gummed adhesive, acrylic adhesive, or a pressure sensitive adhesive. The receptor media 2 is preferably a transparent tape and may include, but is not limited to, cellophane tape or a more permanent, adhesive tape. The receptor media 2 may also include transparent printer labels, which are known in the art. In normal use of such transparent printer labels, however, print imaging is applied to the non-adhesive surface. The present invention proposes, however, that print imaging be applied to such transparent printer labels on the adhesive thereof.

Figure 2:
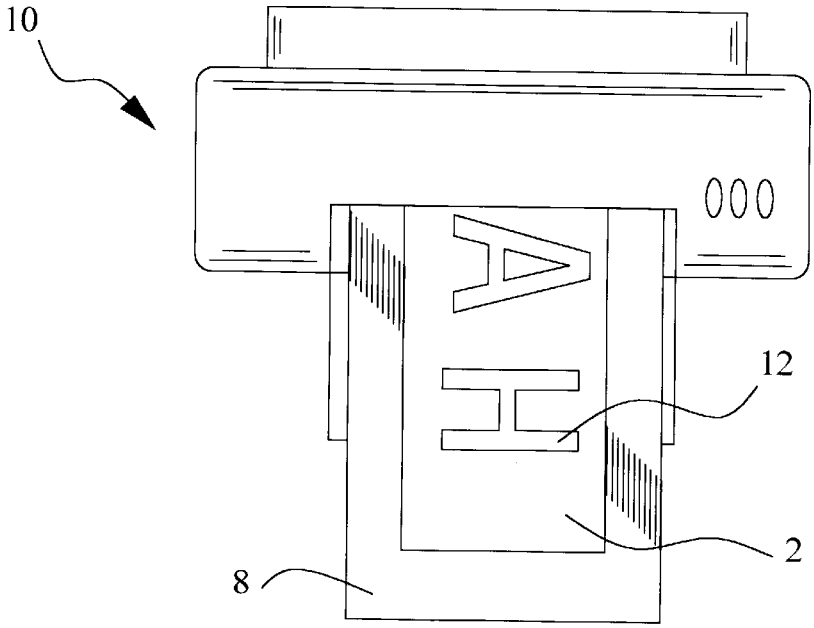
FIG. 2 depicts the transparent tape of FIG. 1 being fed through an inkjet printer with the resulting image printed in reverse.
Figure 3:
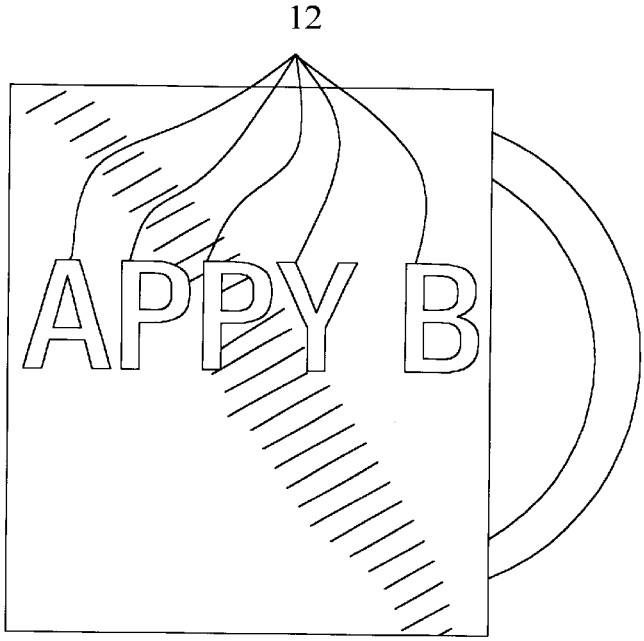
FIG. 3 shows the printed image adhered to a coffee mug.

The receptor media 2 is attached to a carrier 8 that is fed through an inkjet printer 10, as illustrated in FIG. 2. For example, the receptor media 2 may be attached to an 8½×11 inch sheet of printer labels. To attach the receptor media 2 to the sheet, the backing of the sheet is partially peeled back and a window is cut in the backing so that the adhesive of the printer labels is exposed or uncovered. The window must be an appropriate size to firmly attach the receptor media 2. The receptor media 2 is placed into the window so that its adhesive layer 6 is facing outwardly to receive ink during the printing process. The receptor media 2 is firmly held in place by the adhesive of the printer labels. In a variation of this embodiment, the receptor media 2 may be attached to the sheet of printer labels by cutting a window in the label. The window must be slightly smaller than the size of the receptor media 2 so that the receptor media is firmly held in place.

Alternatively, if the receptor media 2 is a sheet of transparent printer labels, a window may be cut into the backing sheet, thus exposing the adhesive side of the labels to be printed on. Depending on the size of the printer labels and the desired images, one or more windows may be cut into the backing. It is understood that any other means of feeding the receptor media through the inkjet printer are included within the scope of the invention.

It is also understood that the inkjet printer 10 may be modified so that the receptor media 2 is directly passed through the printer. For example, a carriage of the inkjet printer 10 may be increased in width to allow the receptor media 2 to be accommodated while still allowing for normal printing applications.

Referring to FIG. 2, an image 12 is printed directly onto the adhesive layer of the receptor media 2 using the inkjet printer 10. In a preferred embodiment of the present invention, the receptor media 2 is transparent tape. However, it is understood that this printing process can be used with any suitable, transparent receptor media known in the art. To begin the process, the receptor media (e.g., a piece of ordinary transparent tape has been used successfully) of an appropriate size to fit a reselected image is provided. The image 12 can be a combination of text or graphics and is limited only by the resolution of the inkjet printer. The image 12 is printed onto the receptor media 2 by feeding the carrier 8, to which the receptor media 2 is attached, through the inkjet printer 10. As with standard inkjet operation, the printing process is controlled so that ink does not pool on the adhesive layer 6 of the receptor media 2. The resulting image appears as a reverse image on the adhesive layer 6 of the receptor media 2, i.e., when viewed from the side of adhesive layer 6. Since inkjet printing is a non-contact printing process, the internal components of the inkjet printer 10 will not contact the receptor media 2. By way of contrast, if the receptor media 2 was used in a contact printing processes, such as thermal transfer printing, the ribbon would adhere to the adhesive layer 6 of the receptor media 2 and prevent the receptor media from traveling through the printer. An image is thus created on the adhesive layer 6 of the receptor media 2 such that it forms a positive image when viewed from the top surface, i.e., plastic layer 4, of the receptor media 2.

Once the ink has dried or set, the image 12 may be applied to any item or object by adhering the tape to the item. Since the ink is printed on the adhesive layer 6 of the receptor media 2, the drying time may under some circumstances be longer than if the image had been printed on plain printer paper. Therefore, to decrease the drying time, use of fast drying inks are preferred. Once applied to an object, the printed image 12 is sandwiched between the plastic layer 4 and the object to which the receptor media 2 has been applied.

The present method of printing labels possesses a number of advantages. For example, since the image is printed on the adhesive layer 6 of the receptor media 2, the image 12 is protected from moisture and scuffing when the receptor media 2 is applied to the item. Additionally, the resulting personalized item looks professionally created because the label appears to be borderless.

The printing process of the present invention, in certain aspects, can be easily performed at home using an unmodified inkjet printer. Since inkjet printers are easy to use, readily available, and relatively inexpensive, this process is useful for low-volume applications or applications where the image on each label is different. Alternatively, the present printing process can be performed using an inkjet printer that has been modified to handle the receptor media 2 of the invention. For example, a printer could be modified by repositioning the drive or feed rollers of an inkjet printer such that the drive rollers have limited contact with the adhesive layer 6 of the receptor media 2, such as positioning the same between labels or at an outer periphery of the receptor media 2 that is free of adhesive. Alternatively, the drive rollers can be redesigned to assume a shape that limits or prevents contact of the same with the adhesive layer 6, such as providing sprocket wheels in place of the rubber wheels typically found in printers. In yet another embodiment of the printing process, the printer may be modified to include a paper path that permits the receptor media 2 to pass through the printer and printing elements therein with minimal or no contact to the adhesive layer 6 thereof.

In the alternate, the image 12 may be printed onto the receptor media 2 by a transfer printing technique. The image 12 is first printed onto a smooth, slick media, such as a transparent, plastic sheet or coated paper. Since the ink does not readily absorb into this media, the image 12 can be easily transferred to a second plastic sheet by applying a clear, self-adhesive plastic sheet over the image 12. When the second sheet is removed, the ink is transferred to the adhesive layer of the second sheet. The second sheet may then be placed on the item to be personalized.

Under another alternative, the adhesive layer 6 of the receptor media 2 may include a pressure-sensitive adhesive. Where the pressure sensitive adhesive is used, the receptor media 2 is easily removed and repositioned, which is desirable when, for example, a user wishes to label or highlight photographs without leaving permanent marks.

Also, the image 12 may be printed on the plastic layer 4 and then overlaid with the adhesive layer 6. The adhesive layer 6 could be applied by a modified print head in the inkjet printer 10, by an aerosol sprayer that was part of the printer, or by independently applying the adhesive layer 6 over the image 12 after the image 12 was printed onto the plastic layer 4 using the previously described techniques of the present invention.

The present invention is designed for use with standard inkjet ink cartridges, such as monochromatic (e.g. single color images) or multi-color ink cartridge units. Accordingly, the present invention shall not be exclusively limited to any particular type of thermal inkjet delivery system, with many different systems being suitable for use. For example, representative commercially-available ink cartridge units which may be employed in connection with the claimed process can be obtained from the Hewlett-Packard Company of Palo Alto, Calif. (USA) under the following product designations/numbers: 51641A, 51645A, 51640C, 51640A, 51629A, and 51649A.

Many different ink materials may be used in producing printed images on the adhesive layer of the receptor media in accordance with the present invention. In this regard, the invention shall not be restricted to the generation of images using any particular ink product. However, at a minimum, the selected ink composition will include an ink vehicle and at least one coloring agent, with the term "coloring agent" being defined to encompass a wide variety of different dye materials and colors including black.

Additional dye materials suitable for use in the invention as the coloring agent are described in the Color Index, Vol. 4, 3rd ed., published by The Society of Dyers and Colourists, Yorkshire, England (1971), which is a standard text that is well known in the art. Exemplary dye materials listed in the Color Index, supra, which are appropriate for use herein include but are not limited to the following compositions: C.I. Direct Yellow 11, C.I. Direct Yellow 86, C.I. Direct Yellow 132, C.I. Direct Yellow 142, C.I. Direct Red 9, C.I. Direct Red 24, C.I. Direct Red 227, C.I. Direct Red 239, C.I. Direct Blue 9, C.I. Direct Blue 86, C.I. Direct Blue 189, C.I. Direct Blue 199, C.I. Direct Black 19, C.I. Direct Black 22, C.I. Direct Black 51, C.I. Direct Black 163, C.I. Direct Black 169, C.I. Acid Yellow 3, C.I. Acid Yellow 17, C.I. Acid Yellow 23, C.I. Acid Yellow 73, C.I. Acid Red 18, C.I. Acid Red 33, C.I. Acid Red 52, C.I. Acid Red 289, C.I. Acid Blue 9, C.I. Acid Blue 61:1, C.I. Acid Blue 72, C.I. Acid Black 1, C.I. Acid Black 2, C.I. Acid Black 194, C.I. Reactive Yellow 58, C.I. Reactive Yellow 162, C.I. Reactive Yellow 163, C.I. Reactive Red 21, C.I. Reactive Red 159, C.I. Reactive Red 180, C.I. Reactive Blue 79, C.I. Reactive Blue 216, C.I. Reactive Blue 227, C.I. Reactive Black 5, C.I. Reactive Black 31, and mixtures thereof. These representative materials are known in the art and commercially available from a variety of sources. Representative sources for dye materials of the type described above and dye sets which may be used in the present invention include but are not limited to the Hewlett-Packard Company of Palo Alto, Calif. (USA), Sands Corporation of East Hanover, N.J. (USA), Ciba-Geigy of Ardsley, N.Y. (USA), and others.

It should also be noted that the term "coloring agent" as used herein shall further encompass pigment dispersion materials known in the art which basically involve a water insoluble colorant (e.g. a pigment) which is rendered soluble through association with a dispersant (e.g. an acrylic dispersant). Specific pigments which may be employed to produce pigment dispersion materials are known in the art, and the present invention shall not be restricted to any particular chemical compositions in this regard. However, as previously indicated, the claimed invention shall not be limited to the dyes and/or pigment dispersion materials listed above. Other chemically comparable materials may be employed which are determined by reasonable investigation to be suitable for the purposes set forth herein. In a preferred embodiment, the ink composition of the invention will include about 2–7% by weight total coloring agent therein (e.g. whether a single coloring agent or combined coloring agents are used).

The ink composition will also include an ink "vehicle" which is essentially used as a carrier medium for the other components in the completed ink product. Many different materials may be employed as the ink vehicle, with the present invention not being limited to any particular compositions for this purpose. A preferred ink vehicle will consist of water, although other supplemental compositions in combination with water including 2-pyrrolidone, ethoxylated glycerol, diethylene glycol, 1,5-pentanediol, N-methyl pyrrolidone, 2-propanol, and 2-ethyl-2-hydroxymethyl-1,3-propanediol may be employed. All of these materials can be used in various combinations as determined by preliminary pilot studies involving the ink compositions of concern. However, in a preferred embodiment, the ink composition will include about 70–80% by weight total combined ink vehicle, wherein at least about 30% by weight or more of the total ink vehicle wilt involve water (with the balance consisting of any one of the above-listed supplemental compositions).

The ink composition may also include a number of optional ingredients in varying amounts. For example, an optional biocide may be added to prevent any microbial growth in the final ink product. Exemplary biocides suitable for this purpose would include proprietary products sold under the trademarks PROXEL GXL by Imperial Chemical Industries of Manchester, England; UCARCIDE 250 by Union Carbide of Danbury, Conn. (USA); and NUOSEPT 95 by Huls America, Inc. of Piscataway, N.J. (USA). Another optional ingredient to be added to the ink composition will involve one or more buffering agents. The use of a selected buffering agent or multiple (combined) buffering agents is designed to stabilize the pH of the ink composition. In a preferred embodiment, the desired pH of the ink composition will range from about 4–9. Exemplary buffering agents suitable for this purpose will comprise sodium borate, boric acid, and phosphate buffering materials known in the art for pH control. The selection of any particular buffering agents and the amount of buffering agents to be used (as well the decision to use buffering agents in general) will be determined in accordance with preliminary pilot studies on the particular ink compositions of concern.

A still further optional ingredient which may be employed in the ink composition is an auxiliary bleed control agent. This material is especially appropriate for multi-color printing systems. Exemplary bleed control agents suitable for this purpose will involve magnesium nitrate, calcium nitrate, or mixtures of both. The selection of any given bleed control agent, the exact amount of bleed control agent to be added, and the general need for a bleed control agent may be determined in accordance with preliminary investigations involving the other components chosen for use in the ink composition. Additional ingredients (e.g. surfactants) may also be included in the ink composition if needed.

It is anticipated that suitable modifications may be made by individuals skilled in the art which nonetheless remain within the scope of the invention. For example, the invention shall not be limited to any particular ink compositions, printing technologies, adhesives, and material layers used to manufacture the receptor media.

Figure 4:
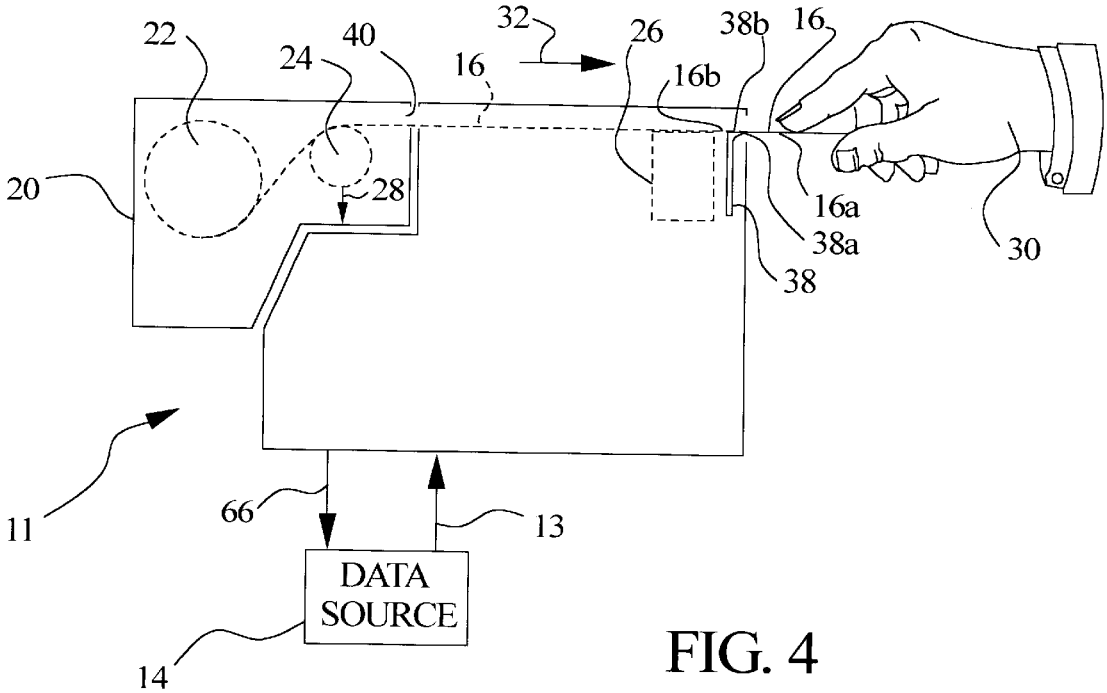
FIG. 4 illustrates a label making inkjet printer according to the present invention operating in response to manual deployment of labels therefrom.

FIG. 4 illustrates schematically, in accordance with the present invention, a label-making printer 11. Printer 11 receives a print job 13 from, for example, a data source 14. As used herein, the term "data source" 14 refers to a variety of sources for print imaging content. For example, data source 14 may include one or various combinations of programmable computing devices, memory devices, keypad or keyboard input devices, application programs executing on personal computers, preprogrammed non-volatile memory, replaceable memory cartridges, and replaceable memory elements. Thus, depending on a particular embodiment of a printing device as described under the present invention, e.g., printer 11 and as described hereafter printer 100, a data source 14 refers to a device automated or manually keyed which produces or makes available print imaging content for rendering on a label.

Printer 11 applies print imaging, i.e., images and text, to an adhesive tape 16. Tape 16 is a transparent adhesive tape bearing on a lower surface thereof an adhesive 16*a* and presenting at the opposite surface a smooth protective surface 16*b*. As will be described more fully hereafter, printer 11 applies print imaging to adhesive 16*a*. A segment of tape 16 bearing print imaging may be adhered to a display or contact surface by virtue of adhesive 16*a* thereby capture between tape 16 and the contact surface the print imaging. This protects the print imaging from smudging or scratching. In other words, a transparent tape 16 allows visibility therethrough while also protecting the print imaging against smudging or other degradation. Tape 16 need not be fully transparent, however, under the present invention. Tape 16 need only be sufficiently translucent to allow visibility of print imaging therethrough. Accordingly, tape 16 may possess some light diffusing or light filtering characteristics, e.g., a tinted tape 16. When tape 16 is transparent, other than the print imaging applied thereto by printer 11, the print imaging appears as if applied directly to the contact surface to which tape 16 adheres. In other words, the body of the resulting label can be substantially invisible except for the print imaging.

Tape 16 need not, however, be a transparent or translucent tape. Print imaging may be produced and be visible through tape 16 by suitable chemical reaction between selected ink formulations and selected adhesive formulations. For example, tape 16 may be provided in opaque form but have chemical characteristics reactive with selective ink formulations to change color or become transparent upon application of such selected ink formulations. Thus, a particular contrast or other such print imaging techniques may be produced through appropriate chemical relationships between ink formulations and adhesive 16*a* of tape 16.

Printer 11 includes a replaceable tape cartridge 20. Cartridge 20 carries therein a reel 22 bearing a supply of tape 16. Cartridge 20 also includes an encoder wheel 24. Thus, cartridge 20 includes an interface for passing tape 16 into printer 11 as well an interface for passing an encoding signal 28 from cartridge 20 into printer 11. As described more fully hereafter, encoder wheel 24 tracks linear transport of tape 16 and produces the encoding signal 28. Encoding signal 28 applies to printer 11 control circuitry operating an inkjet print head 26. Thus, a user 30 grasps an exposed end of tape 16 and pulls, as indicated at reference numeral 32, tape 16 from printer 11. Encoder wheel 24 reports linear movement of tape 16 and thereby permits, through appropriate control and synchronizing circuitry, application of print job 13 to adhesive 16*a* as a function of detected linear movement of tape 16 past inkjet print head 26.

In use, a print job 13 originates at data source 14 and applies to printer 11. User 30 merely grasps an exposed end of tape 16 and pulls tape 16 from printer 11 in the direction indicated at reference numeral 32. Print job 13 may originate from an application program on a personal computer serving as data source 14, be selected from preprogrammed print imaging from a memory device or replaceable memory cartridge serving as data source 14, or from an entry on a keypad serving as data source 14. As tape 16 moves past inkjet print head 26, print imaging according to print job 13 is applied to adhesive 16*a*. Eventually, print job 13 completes and user 30 stops pulling tape 16 from printer 11. User 30 then merely pulls tape 16 against a cutter 38 to take from printer 11 a segment of tape 16, i.e., a printed adhesive label, bearing print imaging on its adhesive 16*a* according to print job 13.

User 30 replaces cartridge 20 when the supply of tape 16 held on reel 22 is exhausted. User 30 also has the option of replacing cartridge 20 with an alternative cartridge 20 having, for example, tape 16 of different width, color, or chemical composition. In other words, user 30 can exchange cartridges 20, even though not yet exhausted, according to particular printing operation needs.

Thus, printer 11 operates in substantially similar fashion to that of a conventional tape dispenser. As tape 16 moves past inkjet print head 26, however, print imaging is applied thereto. User 30 merely grasps and pulls a segment of tape 16 from printer 11 and severs the segment as a printed adhesive label therefrom. User 30 then simply applies the severed segment of tape 16, bearing print imaging on adhesive 16*a,* as a printed adhesive label to a selected contact surface.

As may be appreciated, maintaining tension in tape 16, especially in the vicinity of inkjet print head 26, improves print imaging quality and management of tape 16, i.e., avoids tangling of tape 16 within printer 11. Thus, operation of printer 11 improves by maintaining tension in tape 16. For example, a cartridge 20 can maintain back tension against tape 16 as presented to printer 11 at cartridge outlet 40. A cutter 38 at the output of printer 11 severs tape 16 at its cutting edge 38*a* and provides at its upward-facing surface an anchor block 38*b*. Severing a segment of tape 16 at edge 38*a,* therefore, brings adhesive 16*a* into contact with anchor block 38*b* and thereby resists back tension established within printer 11 or, for example, within cartridge 20.

Figure 5:
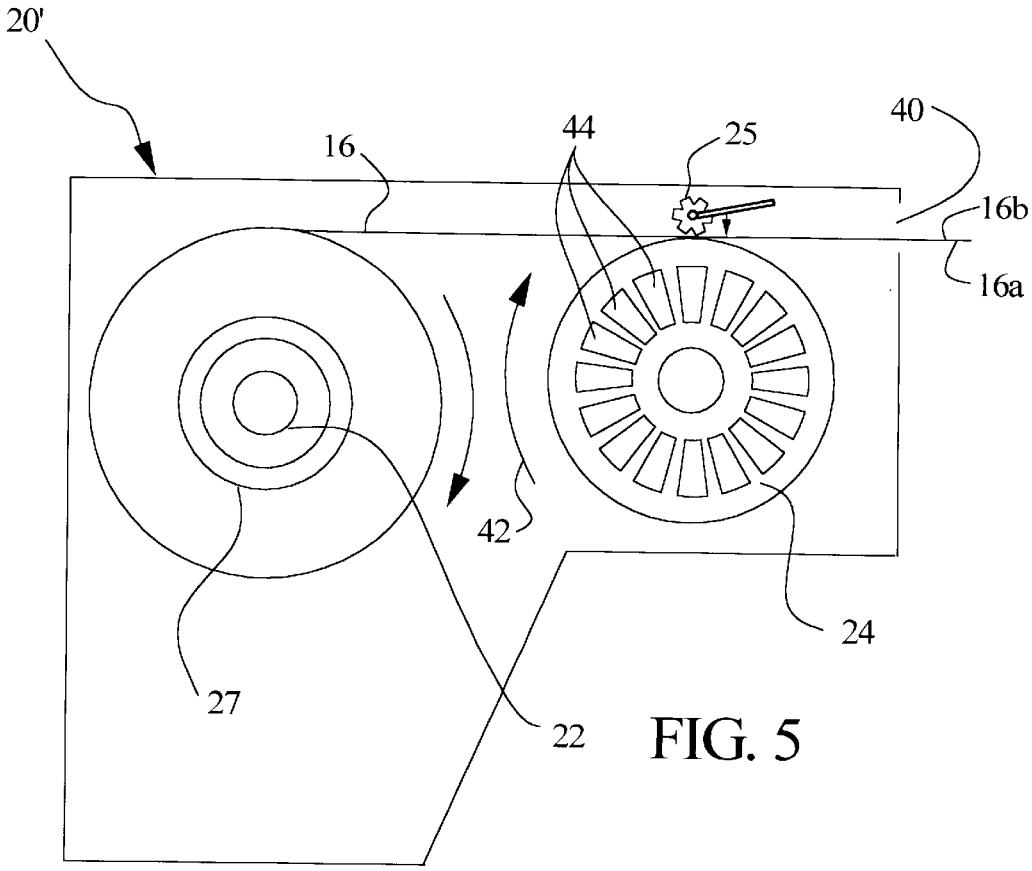
FIG. 5 illustrates a first form of media cartridge as used in conjunction with the label making inkjet printer of FIG. 4.

FIG. 5 illustrates a first form of cartridge 20 indicated at reference numeral 20'. In FIG. 5, tape 16 is provided on reel 22 in conventional fashion, i.e., such as typically found for adhesive tape dispensers. The distal, i.e., free, end of tape 16 passes from reel 22 and engages, i.e., adhesive 16*a* contacts, encoder wheel 24 and then passes from cartridge 20 at the cartridge outlet 40. A freely rotating press wheel 25, provided generally in the form a star with flattened tips, is biased, i.e., bears against, tape 16 and encoding wheel 24 to create a nip thereat. Wheel 25, therefore, maintains good contact between tape 16 and encoder wheel 24. Reel 22 is fitted with a tensioning device 27, e.g., an undulating washer 27, providing resistance to rotation of reel 22 and thereby maintaining back-tension in tape 16.

Encoder wheel 24 rotates, therefore, as indicated at reference numeral 42 in response to passage of tape 16 therepast. Encoder wheel 24 carries circumferentially a series of encoding slots 44. Detecting passage of slots 44 at a given point provides basis for tracking linear movement of tape 16 out of cartridge 20' and through printer 11.

Figure 6:
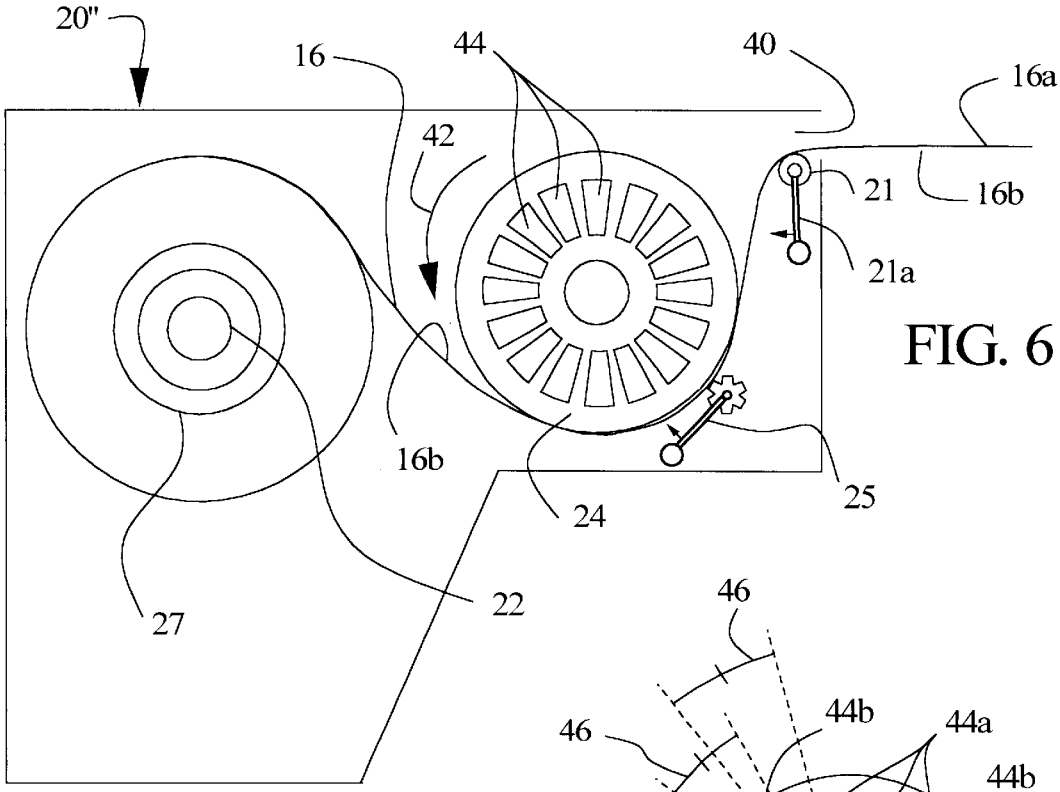
FIG. 6 illustrates a second form of media cartridge used in conjunction with the label making inkjet printer of FIG. 4.

FIG. 6 illustrates an alternative tape cartridge 20 configuration as tape cartridge 20". In FIG. 6, reel 22 carries an inventory of tape 16. Tape 16 moves past encoder wheel 24, but in this case engages wheel 24 at its non-adhesive surface 16*b*. Cartridge 20" also includes a freely rotating press wheel 25 bearing, in this embodiment, against the adhesive 16*a* of tape 16. Wheel 25 insures good contact with encoder wheel 24 and thereby insures accurate representation of tape 16 movement through cartridge 20". Reel 22 is fitted with a tensioning device 27, e.g., an undulating washer 27, providing resistance to rotation of reel 22 and thereby maintaining back-tension in tape 16. A guide wheel 21 located at outlet 40 presents tape 16 to printer 11. Additional tensioning, if necessary, may be provided at wheel 21 by mounting thereof on a biased lever 21*a* as indicated at FIG. 6. Encoder wheel 24 also carries circumferentially a set of encoding slots 44. Detecting passage of slots 44 past a given point provides basis for tracking linear movement of tape 16 out of cartridge 20" at its outlet 40.

Placing encoder wheel 24 in a replaceable tape cartridge, e.g., one of cartridges 20, 20' or 20", prevents excessive build up of adhesive on encoding wheel 24. In other words, when adhesive 16*a* of tape 16 contacts encoding wheel 24 it may transfer to some extent adhesive material onto encoding wheel 24. While such transfer is not considered in the short term a problem with respect to reliable operation of wheel 24, it is possible that over an extended period of time such adhesive build up may impair wheel 24 operation. Accordingly, placing encoding wheel 24 within a replaceable tape cartridge avoids excessive build up of adhesive and, therefore, excessive build up and impairment of encoding wheel 24. As described more fully hereafter, encoding wheel 24 may be used to produce additional information specific to a given cartridge 20, 20' or 20".

While illustrated herein as encoding slots 44, other structures or features may be provided on an encoding wheel 24 to perform similar functions. For example, reflective surfaces, raised surfaces, and other such features of an encoding wheel 24 may be provided to provide basis for tracking rotation of encoding wheel 24, and therefore, tracking the linear movement of tape 16. It will be understood, therefore, that the present invention is not limited to use of slots 44 as a method of encoding tape 16 linear movement. Thus, a broad variety of devices and methods may be used to indicate tape 16 movement including, but not limited to, optical devices such as occlusion and reflective optical devices, magnetic devices, capacitive devices, resistive devices, and inductive devices. In each case, however, an encoding signal 28 represents tape 16 movement.

Figure 7:
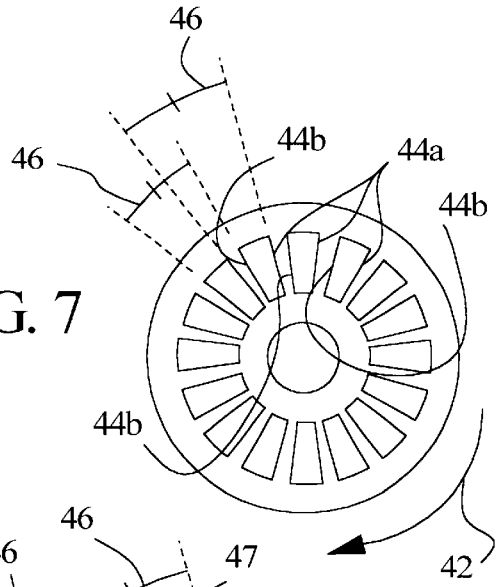
FIG. 7 illustrates an encoding wheel for the label making inkjet printer of FIG. 4 and cartridges of FIGS. 5 and 6.
Figure 8A:
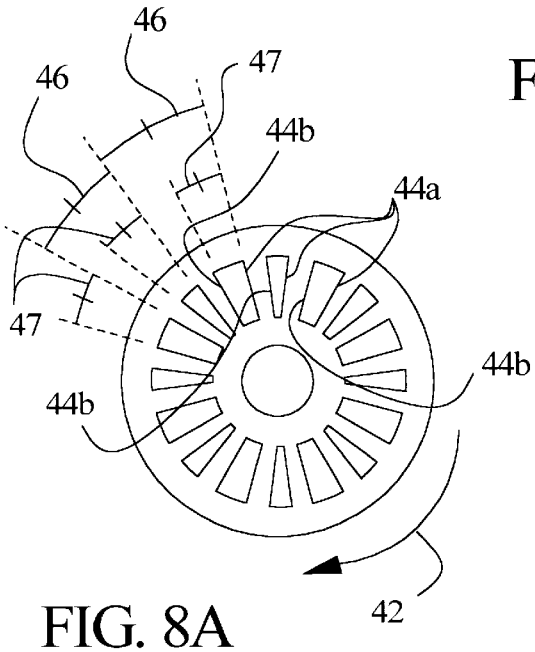
FIGS. 8A and 8B illustrate second and third forms of encoding wheels for the label making inkjet printer of FIG. 4 and cartridges of FIGS. 5 and 6.
Figure 8B:
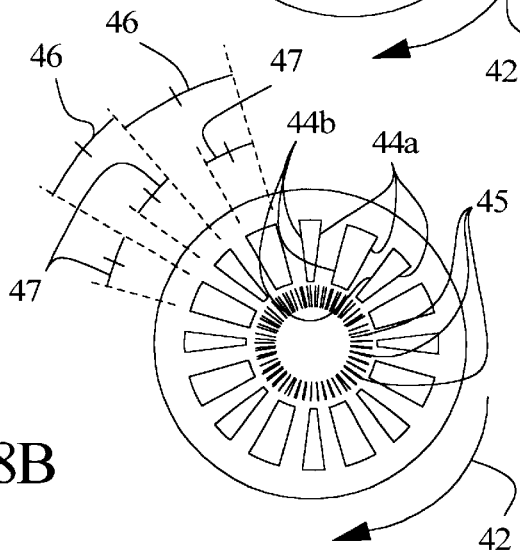

FIGS. 7, 8A, and 8B illustrate use of encoding slots 44. As illustrated herein, slots 44 are disproportionate relative to actual implementation. For purposes of illustration, only a few slots 44 are shown evenly distributed circumferentially about wheels 24. It will be understood, however, that in a particular implementation the number of slots 44 actually placed on a wheel 24 would likely be much greater than that illustrated herein. In other words, a greater number of slots 44 provide a higher resolution encoding signal 28 and thereby support, as will be described more fully hereafter, higher resolution print imaging.

In FIG. 7, encoding slots 44 are uniform circumferentially about encoding wheel 24, i.e., evenly spaced at a given angular offset 46. As such, encoding slots 44 provide sufficient information to track the linear movement of tape 16 past wheel 24. More particularly, linear movement of tape 16 past wheel 24 provides a basis for synchronizing operation of inkjet print head 26 in applying print imaging thereto according to a designated print job 13. Inkjet print head 26 operates generally in conventional fashion, i.e., receives an impulse signal firing a column of selected ink droplets onto tape 16. Generally, each slot 44 triggers such firing in inkjet print head 26. In other words, the leading edge 44*a* of each slot 44 corresponds to, i.e., causes when detected, actuation or firing of inkjet print head 26. Thus, resolution of slots 44, i.e., the density of slots 44, on encoding wheel 24 corresponds to the resolution of print imaging produced on tape 16. For an encoding wheel 24 having 150 to 200 slots 44 circumferentially per inch, inkjet print head 26 fires 150 to 200 times, respectively, per linear inch of tape 16. As may be appreciated, greater or lesser resolution may be provided by increasing or decreasing the number of slots 44. Furthermore, particular control circuitry or programming schemes may be developed for alternative methods of controlling inkjet print head 26 operation in response to an encoding signal 28. The proposed use of each slot 44 individually firing inkjet print head 26 operation finds advantage in its simplicity and acceptable levels of resolution in most uses of tape 16 contemplated herein.

FIG. 8A illustrates additional encoding information provided by slots 44 beyond tape 16 transport movement. In FIG. 8A, the leading edges 44*a* of each slot 44 are evenly spaced at a given angular offset 46. The trailing edges 44*b*, however, have variation in angular offset 47 relative to the corresponding leading edge 44*a* of the same slot 44. Thus, detecting passage of leading edges 44*a* past a fixed point provides basis for tracking the linear movement of tape 16 and, in this particular embodiment, firing inkjet print head 26. Detecting the trailing edges 44*b* relative to the corresponding leading edge 44*a*, however, provides additional information according to a variety of potential tape 16 characteristics. For example, the angular offset 47 between a leading edge 44*a* and a trailing edge 44*b* provides information such as the color of tape 16, the width or color of tape 16, the chemical composition of tape 16 or adhesive 16*a*, and other such characteristics as may be pertinent to application of print imaging thereon.

Because tape 16 transport is by manual control, i.e., under user 30 manual pulling tape 16 from printer 11, consistent velocity may not be achievable and not be available as a reliable basis for detecting angular offset 47 between leading edges 44*a* and trailing edges 44*b*. In some mechanical implementations it may be possible to introduce sufficient inertia, or use governing mechanisms, stabilizing tape 16 velocity. To the extent that tape 16 velocity may be stabilized, angular offset 47 between a given leading edge 44*a* and corresponding trailing edge 44*b* may be quantified by a time interval measurement, i.e., the width of a pulse in encoding signal 28. Constant tape 16 velocity, however, need not be present to measure variation in angular offset 47 between a leading edge 44*a* and corresponding trailing edge 44*b*.

Encoding wheel 24 may be provided with additional reference slots 45 to provide a basis for measuring an angular offset 47 between leading edges 44*a* and trailing edges 44*b*. In FIG. 8B, encoding wheel 24 includes a second set of slots, i.e., reference slots 45, at higher resolution than slots 44. Thus, additional detecting circuitry (not shown) directed at reference slots 45 can count a number of reference slot 45 occurrences between a leading edge 44*a* and a trailing edge 44*b* and thereby provide basis for differentiating angular offsets 47 among a series of slots 44. In other words, counting the number of reference slots 45 between a leading edge 44*a* and a trailing edge 44*b* quantifies the angular offset 47 therebetween.

Accordingly, a cartridge 20 and tape 16 therein identification scheme can be developed based on a pattern of slot 44 angular offset 47 sequences regardless of the speed or variation in speed of tape 16 occurring as a result of manual deployment of tape 16 from printer 11.

Thus, by providing the encoding wheel 24 as a portion of the cartridge 20, characteristics specific to tape 16 within a given cartridge 20 are designated as a function of angular offsets 47 and provided as a media signal 66 (FIG. 4).

Figure 9:
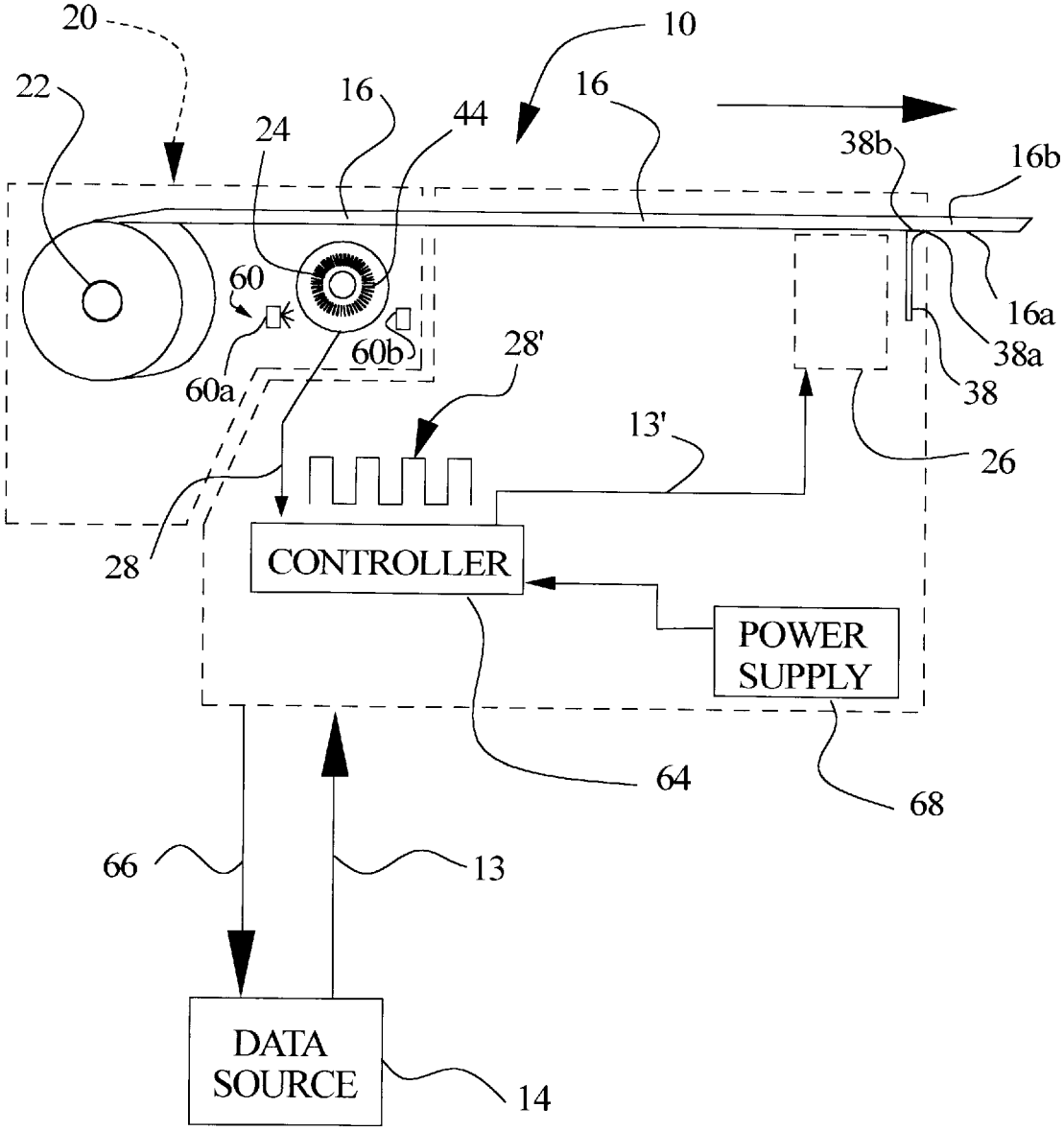
FIG. 9 illustrates schematically the label making inkjet printer of FIG. 4 and its use in a label making printing operation.

FIG. 9 illustrates schematically printer 11, cartridge 20, and data source 14. In FIG. 9, cartridge 20 includes reel 22 dispensing tape 16 past encoding wheel 24 as described above. Printer 11 includes at its physical interface with cartridge 20 a photo detector 60 positioned to detect passage of slots 44 of encoding wheel 24 therepast. Detector 60 includes a light emitting device 60*a* and a light detecting device 60*b*. Alternatively, encoding circuitry and signal generating components could be located within each cartridge 20. Wheel 24 lies intermediate devices 60*a* and 60*b* and light emitted from device 60*a* reaches device 60*b* only when a slot 44 lies therebetween. Accordingly, encoding signal 28 as provided by detector 60 includes a series of pulses 28'. Each pulse 28' corresponds to a slot 44. The leading edge of each pulse 28' corresponds to a leading edge 44*a* and a falling edge of each pulse corresponds trailing edge 44*b* of each slot 44. Thus, encoding signal 28 represents the pattern of slots 44 as provided on a particular encoding wheel 24 and passing detector 60. As may be appreciated, in implementation of additional signals from encoding wheel 24, e.g., use of reference slots 45 to identify tape 16 characteristics, signal 28 would include a second signal, or additional signal component, corresponding to, for example, reference slots 45.

Printer 11 includes a controller 64. Controller 64 may take a variety of forms including, but not limited to, programmable computing devices, dedicated micro controllers, or any control circuitry capable of orchestrating printing operations as described herein. In certain applications, controller 64 may assume a substantially passive role as, for example, simply a signal interface relative to a more complex data source 14. Controller 64 receives print job 13 from data source 14. In other applications, however, controller 64 may include significant processing and memory resources in implementation of the present invention. Controller 64 also receives encoding signal 28 from detector 60. A power supply 68 supplies the power necessary for operation of controller 64.

Controller 64 passes print job 13 as print job 13' to inkjet print head 26 as a function of, i.e., as synchronized with, encoding signal 28. In other words, controller 64 takes into account the linear movement of tape 16 as represented by encoding signal 28 and drives inkjet print head 26 according to print job 13' and the detected linear movement of tape 16 through printer 11. Thus, the asynchronous and variable speed of tape 16 resulting from manual deployment is accommodated by controller 64 to provide print imaging on tape 16 as intended, i.e., as represented in print job 13 and as provided by data source 14.

Controller 64 also provides a media signal 66 representing particular characteristics of tape 16. In other words, encoding signals taken from wheel 24 bear certain information specific to a particular media, i.e., tape 16, as loaded in printer 11. Printing operations take into account media signal 66 to appropriately format print job 13 for application to tape 16 in, for example, both color and size requirements. For example, if data source 14 is a personal computer, then user applications producing print job 13 can take into account media signal 66 to better format and prepare print imaging for application to a particular form of tape 16, e.g., particular tape 16 width or color.

With respect to size requirements, it will be appreciated that a particular tape 16 while having a specific width limitation has no particular length limitation, other than its overall length, with respect to a print job 13. Thus, printing applications are limited as a function of the width of a particular tape 16 but are not necessarily limited in length along a particular tape 16. Thus, a particular print job 13 may occupy a variable and significant amount of linear distance along tape 16. In contrast, conventional label-making printing operations frequently have limitations with respect to both height and width. In accordance with the present invention, labels may be provided at arbitrary dimensions along the linear dimension of a segment of tape 16 as taken from printer 11. Furthermore, by providing a conventional inkjet print head 26 a variety of fonts and printing techniques are available including mixed fonts, variation in number of lines produced, and graphics. Furthermore, inkjet print heads 26 may be provided with multiple ink colors and, in conventional fashion, produce colored print imaging through a broad spectrum of available colors.

Thus, while limited according to the width of tape 16, labels produced by printer 11 may be of arbitrary and significant length with mixed fonts, number of lines, and graphics according to the print job 13 as supplied by data source 14.

Figure 10:
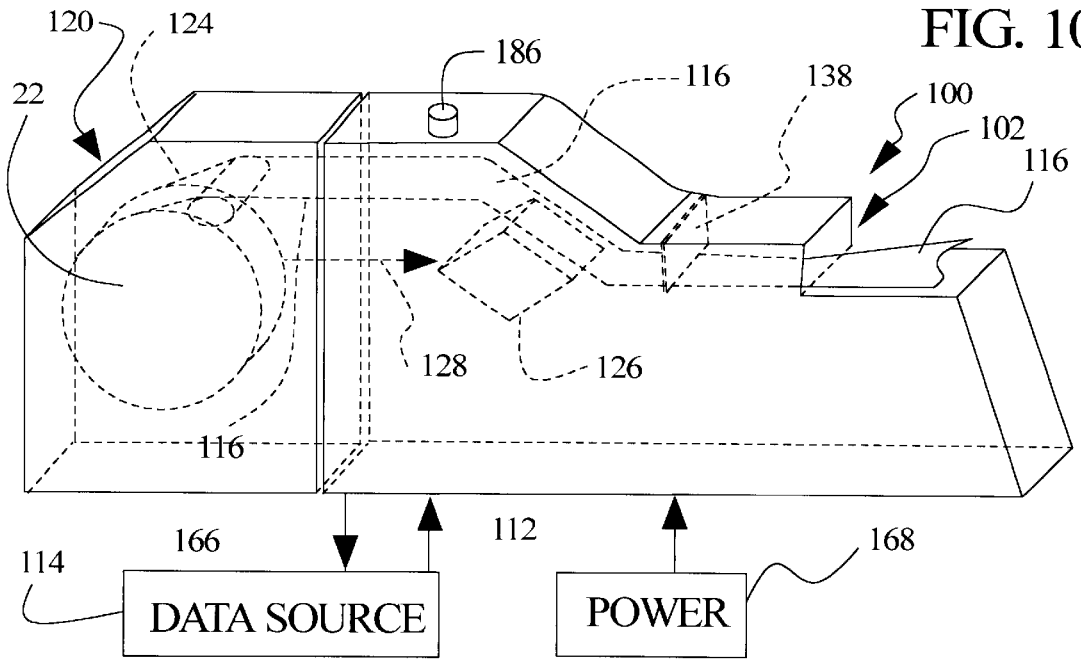
FIG. 10 illustrates a label making inkjet printer according to the present invention including automated deployment of media therefrom.

FIG. 10 illustrates a further embodiment of the present invention, a motorized label-making printer 100. Printer 100 operates in conjunction with a tape cartridge 120. Tape cartridge 120 is similar to tape cartridge 20 as described above and includes a reel 122 carrying a supply of adhesive tape 116 thereon. Cartridge 120 also includes an encoding wheel 124 similar to wheel 24 of cartridge 20. In addition to reporting linear movement of tape 116 as encoding signal 128, wheel 124 encoding also provides information concerning characteristics specific to the particular cartridge 120, e.g., color, width, or other such specific characteristics of tape 116. Printer 100 receives a print job 112 from a data source 114. Printer 100 reports a cartridge media signal 166 providing information specific to the particular cartridge 120 loaded on printer 100 at that time.

Printer 100 differs from printer 11, however, in its use of a motorized media transport conveying tape 116 from reel 122 through printer 100 for delivery at printer 100 output 102. As will be described more fully hereafter, printer 100 includes an inkjet print head 126 positioned adjacent the tape 116 transport path for applying print imaging, e.g., text and graphics, to the adhesive side 116*a* of tape 116. Thus, printer 100 also delivers labels in the form of arbitrary length tape 116 label segments taken from printer 100 and applicable to a selected contact surface. When tape 16 is transparent, such print imaging appears as if printed directly on the contact surface to which tape 116 attaches. As with tape 16, however, transparency is not a requirement and specific chemical reactions may be induced through selected ink formulations and adhesive reactions thereto to produce a variety of print imaging features and characteristics on a tape 116 even if originally provided in opaque form.

Figure 11:
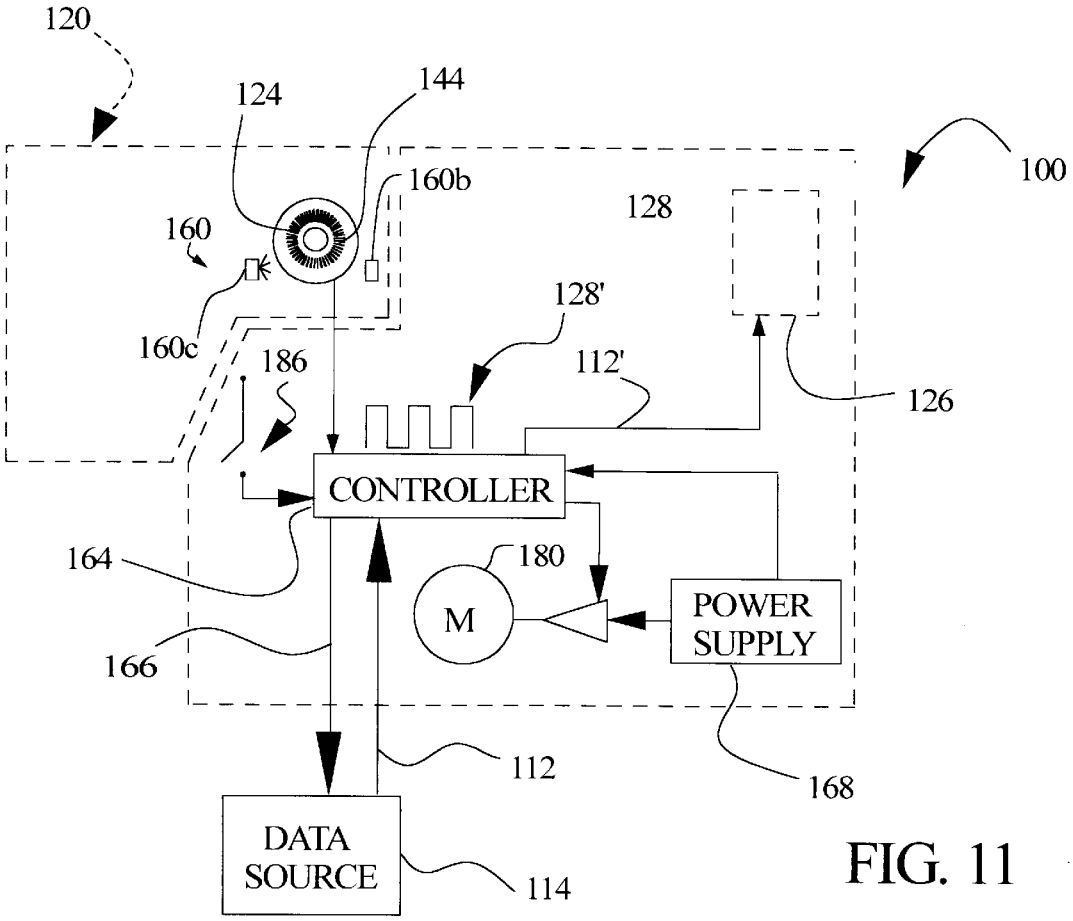
FIG. 11 illustrates schematically the label making inkjet printer of FIG. 10.

FIG. 11 illustrates schematically printer 100 as including power supply 168 and a controller 164 driving inkjet print head 126. Controller 164 receives the encoding signal 128 from a detector 160. Detector 160 detects passage of encoding slots 144 therepast. Detector 160 includes a light emitting element 160*a* and a light detecting element 160*b* and encoding signal 128 appears as a series of pulses 128' with each pulse 128' corresponding to passage of an encoding slot 144 through detector 160. In this manner, controller 164 coordinates a print job 112' as applied to inkjet print head 126 in synchronized relation to tape 116 transport through printer 100 as a function of encoding signal 128. A tape 116 transport mechanism, described more fully hereafter, includes a drive motor 180. In this manner, motor 180 coordinates tape 116 transport through printer 100 as a function of encoding signal 128. Controller 164 provides a drive signal 182 via a motor driver 184 to motor 180.

In operation, once a print job 112 has been submitted to controller 164, controller 164 meters further submission of print job 112 as print job 112' directly to inkjet print head 126 as a function of encoding signal 128. Because printer 100 transports tape 116 through printer 100, the user must be prepared to collect tape 116 from printer 100 as printer 100 produces a printed label. A trigger switch 186 allows the user to initiate transport of tape 116 through printer 100 when the user is ready to collect tape 116 from printer 100. A user operating a personal computer as data source 114, for example, initiates print job 112 and thereafter collects the output of printer 100 by grasping an exposed end of tape 116 at printer 100 output 102 and activating switch 186. Printer 100 then transports tape 116 through printer 100 as the user withdraws the label segment of printed tape 116 from printer 100. Once the print job 112 is complete, printer 100 ceases transport of tape 116 through printer 100. The user severs the resulting label at cutter 138 near output 102 of printer 100.

Switch 186 may be implemented, however, by a variety of methods. For example, switch 186 may be implemented a tension-sensitive switch responsive to user 30 grasping tape 116 and pulling tape 116 from printer 100. Accordingly, such tension-sensitive switch 186 automatically reacts to a user grasping tape 116 and printer 100 thereby begins printing automatically in response to a user collecting tape 116 from printer 100.

Figure 12:
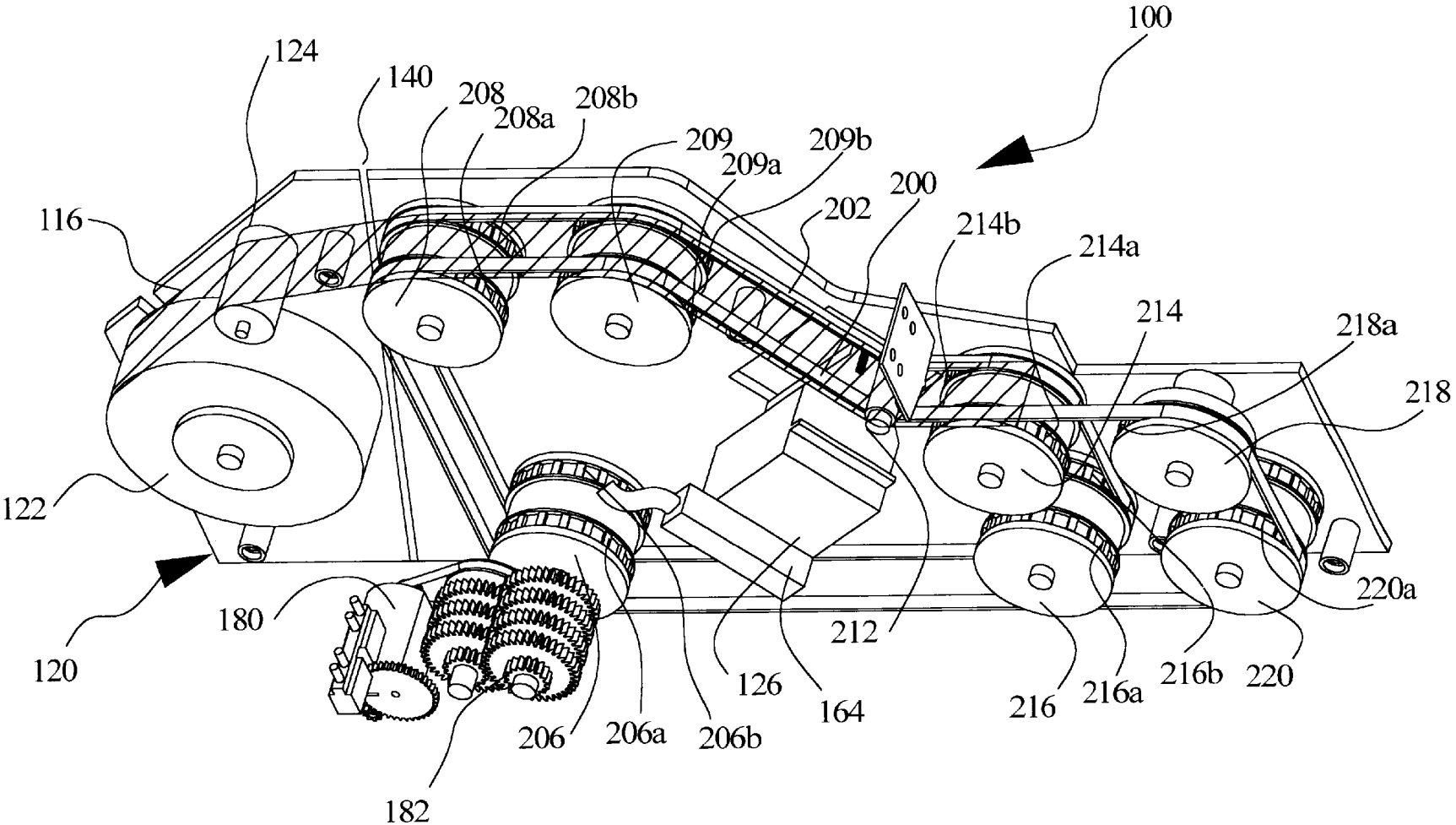
FIG. 12 illustrates in greater detail the internal mechanical components of the label making inkjet printer of FIG. 10.

FIG. 12 illustrates further the interior components of printer 100. In FIG. 12, tape 116 transport occurs by way of a pair of belts 200 and 202. Belts 200 and 202 are toothed belts interfittng a series of sprocketed pulleys described more fully hereafter. Drive motor 180 couples by way of drive transmission 182 to a drive pulley 206. Drive pulley 206 carries a pair of sprockets, individually, sprockets 206*a* and 206*b*, interfitting with belts 200 and 202 respectively. Pulleys 208 and 209 positioned directly above pulley 206 and near the outlet 140 of cartridge 120 each carry a pair of sprockets thereon. More particularly, pulley 208 carries sprockets 208*a* and 208*b* and pulley 209 carries sprockets 209*a* and 209*b*. A roller 212 engages the opposite surface, i.e., opposite of the toothed portion, of belts 200 and 202 and maintains tape 116 in position adjacent inkjet print head 126. Pulleys 214 and 216 each carry a pair sprockets thereon. In particular, pulley 214 carries sprockets 214*a* and 214*b* engaging belts 200 and 202 respectively. Similarly, pulley 216 carries sprockets 216*a* and 206*b* and engages thereat belts 200 and 202, respectively. Pulleys 214 and 216 lie just upstream, i.e., relative to tape 116 transport direction, of printer 100 output 102. Pulleys 218 and 220, however, are positioned just beyond output 102. Pulleys 218 and 220 each carry a sprocket, individually sprockets 218*a* and 220*a*, and engage only belt 200.

Thus, belts 200 and 202 move synchronously about their respective pulleys but have different paths. In particular, belt 200 engages pulley 206, pulley 208, pulley 209, roller 212, pulley 214, pulley 218, and pulley 220. Belt 202, however, engages pulley 206, pulley 208, pulley 209, roller 212, pulley 214 and pulley 216. In other words, belt 202 extends past printer 100 output 102 and passes around pulleys 218 and 220 whereas pulley 202 does not extend past printer 100 output 102 and makes its turn back to drive motor 180 at pulleys 214 and 216.

While illustrated as including a significant path about various pulleys within printer 100, an important feature of belts 200 and 202 is the extended transport of tape 116 at one edge of tape 116 relative to the opposite edge of tape 116 near output 102. Thus, alternative forms of printer 100 may be implemented with a less significant belt 200 and 202 architecture. In other words, the present invention may be implemented according to a variety of mechanical arrangements for transporting tape 116 through printer 100. In accordance with one aspect of the present invention, however, tape 116 is carried at output 102 at one edge thereof by freeing and making available the opposite edge to be grasped by a user. For example, the present invention could be implemented using a single belt moving in a generally smaller and rectangular path about only pulleys 214, 216, 218, and 220. This belt could carry one edge of tape 116 past output 102 of printer 100. Other mechanisms responsible for transporting tape 116 through printer 100 could be implemented according to a variety of methods and need not be necessarily carried at its edges throughout its transport. Of note, however, carrying tape 116 at its edges through the print zone established by inkjet print head 126 leaves a space between belts 200 arid 202 defining a print zone in which the adhesive portion of tape 116 is exposed to inkjet print head 126. In the alternative, tape 116 can be held in tension through a print zone such as tape 16 in printer 11.

The upper surface of belts 200 and 202 is particularly adapted for temporarily adhering to adhesive 116*a* of tape 116. Thus, as tape 116 exits cartridge 120 it lies across belts 200 and 202 along its outer edges and along the segment of belts 200 and 202 at pulleys 208, 209, roller 212, and pulley 214. Because belt 200 extends beyond belt 202 at the output 102 of printer 100, tape 116 loses contact with belt 202 at output 102. This provides opportunity for the user to grasp a free edge, i.e., the edge previously in contact with belt 202, at output 102 and collect tape 116 from printer 100 as belts 200 and 202 transport tape 116 through printer 100. In operation, the user merely collects tape 116 by gently pulling thereon to remove a printed adhesive label from printer 100 as drive motor 180 propels belts 200 and 202 about their respective paths and releases tape 116 therefrom at output 102 of printer 100.

Figure 13:
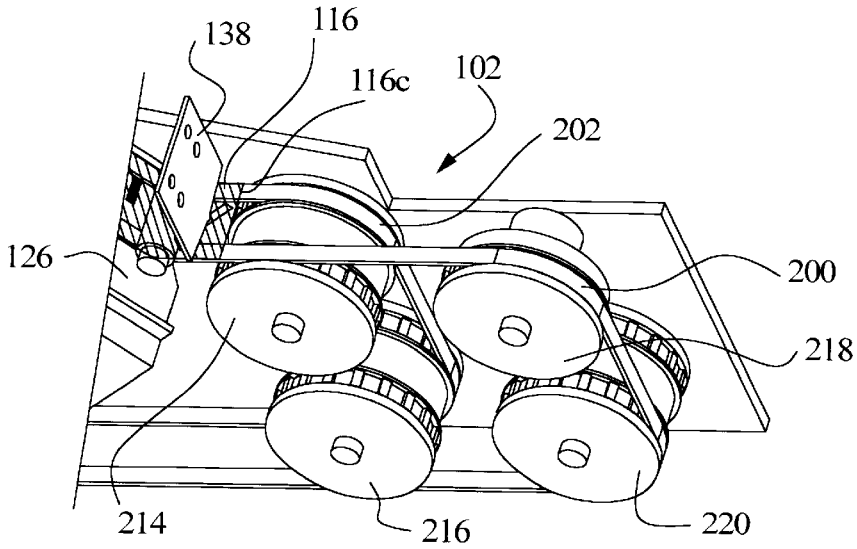
FIGS. 13–15 illustrate sequentially deployment of a tape-form label from the label-making inkjet printer of FIG. 10.
Figure 14:
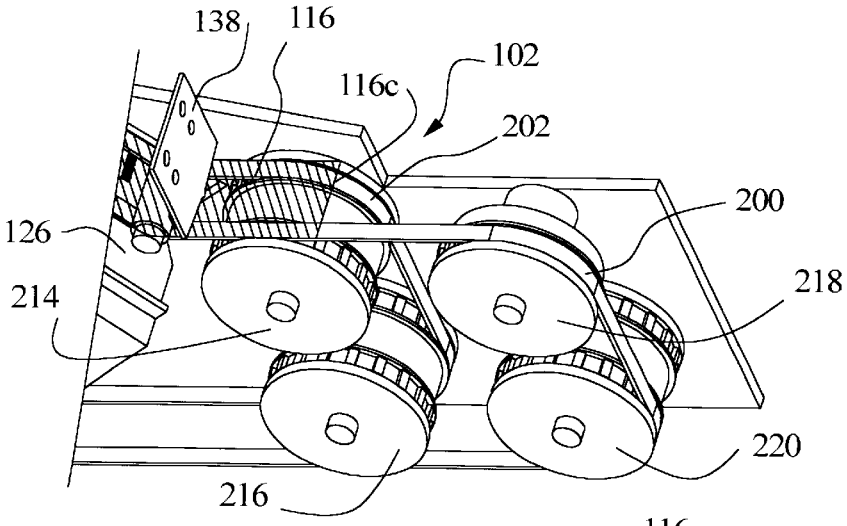
Figure 15:
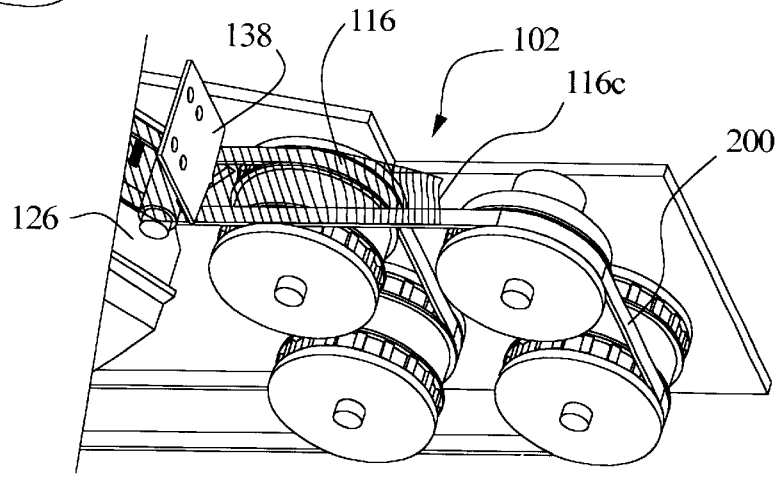

FIGS. 13–15 illustrate in sequence movement of a distal end 116*c* of tape 16 through output 102 in accordance with one aspect of the present invention. In FIG. 13, distal end 116*c* has passed inkjet print head 126 and cutter 138 and is approaching pulley 214. Belts 200 and 202 support tape 116 at its right and left respectively, edges. As shown in FIG. 14, distal end 116*c* has advanced over pulley 214. At this point, belt 202 diverges downward toward pulley 216 and belt 200 continues forward toward belt 218. As a result, and as shown in FIG. 15., the left of tape 116 loses contact with belt 202 while belt 200 remains in contact with the right edge of tape 116. Accordingly, the left edge of tape 116 has separated from belt 202 and is available for collection by a user. In other words, the user grasps the left edge of tape 116 and as printer 100 continues to eject tape 116 therefrom, the user maintains tension in the deployed tape 116 until motorized deployment ceases, i.e., until the print job 112 is complete. At this point, the user merely lifts upward to bring tape 116 against cutter 138 and thereby remove from printer 100 a segment of tape 116 as a label bearing print imaging thereon according to print job 112.

Thus, printer 100 operates substantially as a motorize tape dispenser allowing a user to apply print imaging and merely withdraw from printer 100 a segment of tape 116 as a ready-to-apply label. In other words, the user simply peels tape 116 from printer 100 and thereafter applies tape 116 as a label to a contact surface.

As will be appreciated, printer 100 by virtue of tape 116 transport under motorized control moves tape 116 at substantially constant velocity. Accordingly, encoding signal 128 occurs against a reasonably predictable and correspondingly constant time base. Thus, additional encoding slots on wheel 124 are not necessary for purposes of detecting angular offset 47 between a leading edge 44*a* and a trailing edge 44*b* in implementation of cartridge 120 and tape 116 identification. In a particular implementation, however, additional encoding slots on wheel 124 may be used in producing a feed back signal applied, for example, to the motor control system.

With respect to cartridge identification, while illustrated herein as taken from a signal generated from an encoding wheel contained within a given cartridge 20 or 120, a variety of other methods of identifying a particular cartridge 20 or 120 may be implemented including, but not limited to, notches or physical features of a given cartridge 20 or 120 detected when placed in printer 11 or printer 100. Additionally, a variety of optical, resistive, inductive, and capacitive techniques may be employed to "read" an identification value from a given cartridge 20 or 120. Thus, the present invention shall not be limited to a particular method or mechanism to identify a given cartridge 20 or 120. The present invention in certain aspects does contemplate, however, use of some form of cartridge 20 or 120 identification to allow printing operations better adaptation in formatting relative to a particular tape 16 or 116 proposed for receiving print imaging. For example, tapes 16 and 116 maybe provided in a variety of colors, widths, or chemical compositions and thereby be better adapted to receive print imaging in a particular size or according to a particular ink formulation.

Furthermore, while illustrated herein as taking an encoding signal 28 or 128 from a cartridge 20 or 120, it will be understood that a variety of other methods of detecting tape 16 or tape 116 movement may be employed including placement of encoding devices within the printer itself as opposed to within a cartridge mounted to the printer.

As may be appreciated, inkjet print heads 26 and 126 are positioned at right angles to the direction of media advance, rather than parallel to the direction of media advance as in conventional printers. The "printable area" of tape 116 is that portion between belts 200 and 202 and exposed to inkjet print head 126. The "printable area" of tape 16 extends more fully across tape 16 as used in printer 11 as no supporting structures, e.g., belts, need be positioned at adhesive 16*a* in the vicinity of inkjet print head 26. So long as the print head swath height is sufficiently wide, i.e., wide enough for the printable area exposed to print heads 26 and 126, there is no need to move inkjet print heads 26 and 126, i.e., no printer carriage is required. Electronic circuitry supporting operation of printers under the present invention is simpler than that of typical printers because there is only one print swath and no need for carriage control circuitry or software.

The present invention eliminates many of the shortcomings of a conventional label-making printer by allowing mixed text and graphics, multiple fonts, and fall color printing. In other words, inkjet printer heads 26 and 126 are conventional inkjet printers and may be figured with a variety of ink sources, e.g., color and black with graphics and mixed color capabilities. Because the printing technique is borderless, i.e., not limited in dimension along the length of tapes 16 or 116, printers 11 and 100 produce a label that appears as if the print imaging was directly printed on whatever surface to which the label has been attached, e.g., plastic, metal, or other surface with no visible border, i.e., the media itself essentially disappears when applied to a contact surface in its ultimate use.

As will be appreciated, because the print imaging is applied to adhesive 16*a* or 116*a,* i.e., the adhesive side of tapes 16 and 116, respectively, but viewed through tapes 16 and 116, print imaging must be suitably reversed relative to conventional printing. This can be done in the submission of data from data sources 14 and 114 or in controller 64 or 164 according to a variety of conventional print imaging processing methods.

It will be appreciated that the present invention is not restricted to the particular embodiment that has been described and illustrated, and that variations may be made therein without departing from the scope of the invention as found in the appended claims and equivalents thereof.

What is claimed is:

1. An inkjet printer comprising:

an inkjet print head defining a print zone adjacent thereto;

media transport moving selected media through said print zone, said media including an adhesive surface exposed to said inkjet print head, said media transport operating by motorized motive force, said media transport carrying said media at an outlet of said printer on one side of said media, an opposite side of said media being unsupported by said transport, aid media transport comprising at least one belt, said belt supporting said one side of said media at said printer outlet; and control activating said inkjet print head in response to and in coordination with movement of media through said print zone.

2. An inkjet printer comprising:

an inkjet print head defining a print zone adjacent thereto;

media transport moving selected media through said print zone, said media including an adhesive surface exposed to said inkjet print head; and control activating said inkjet print head in response to and in coordination with movement of media through said print zone, said media transport operating by manual motive force, said manual motive force originating from manual tension applied to said media to draw said media through said printer.

3. An inkjet printer comprising:

an inkjet print head defining a print zone adjacent thereto;

media transport moving selected media through said print zone, said media including an adhesive surface exposed to said inkjet print head;

a control activating said inkjet print head in coordination with movement of media through said print zone; and a media cartridge, the cartridge including said media having on at least one side thereof said adhesive surface, including a cartridge outlet deploying said media therefrom; and including an encoding device reporting movement of said media.

4. An inkjet printer according to claim 3, wherein said media is provided in reel-form.

5. An inkjet printer according to claim 3, wherein said media is transparent.

6. An inkjet printer according to claim 3 wherein said media is opaque and reactive to selected ink formulations to modify at least one of opacity and coloration in reaction thereto.

7. An inkjet printer according to claim 3 wherein said encoding device reports movement of said media relative to said cartridge outlet.

8. An inkjet printer according to claim 3 wherein said encoding device is positioned intermediate a source of said media within said cartridge and said cartridge outlet.

9. An inkjet printer according to claim 3 wherein said encoding device comprises:

a rotatable element coupled to said media and rotating in response to movement of said media; and a detector reporting rotation of said encoding device as an encoding signal.

10. An inkjet printer according to claim 9 wherein said detector comprises slot formations of said encoding wheel and optical elements detecting passage of said slots thereby, said optical elements originating said encoding signal.

11. An inkjet printer according to claim 3 wherein said media cartridge contributes to back-tension relative to said media as presented at said cartridge outlet.

12. An inkjet printer comprising:

an inkjet print head defining a print zone;

a reel-form media; a media feed path originating at said reel-form media and passing through said print zone to a printer outlet;

a detector reporting manual movement of media along said feed path and triggering operation of said in jet printer; and a media cartridge, said media cartridge providing a source of media and positioned for introduction of raid media into said media feed path, said detector being positioned intermediate said source of media within said cartridge and a cartridge outlet.

13. An inkjet printer comprising:

an inkjet print head defining a print zone;

a reel-form media;

a media feed path originating at said reel-form media and passing through said print zone to a printer outlet; and a detector reporting manual movement of media along said feed path and triggering operation of said inkjet printer, media including on at least one side thereof an adhesive, said inkjet printer applying print imaging to said adhesive.

* * * * *

UNITED STATES PATENT AND TRADEMARK OFFICE

CERTIFICATE OF CORRECTION

PATENT NO. : 6,648,533 B2
DATED : November 18, 2003
INVENTOR(S) : Lo et al.

It is certified that error appears in the above-identified patent and that said Letters Patent is hereby corrected as shown below:

Column 20,
Line 37, delete “in” and insert in lieu thereof -- ink --;
Line 41, delete “raid” and insert in lieu thereof -- said --.

Signed and Sealed this

Twenty-sixth Day of October, 2004

JON W. DUDAS
*Director of the United States Patent and Trademark Office*